US012252301B2

(12) United States Patent
Tseng et al.

(10) Patent No.: US 12,252,301 B2
(45) Date of Patent: Mar. 18, 2025

(54) MULTICOMPARTMENT BAG

(71) Applicant: INTEPLAST GROUP CORPORATION, Livingston, NJ (US)

(72) Inventors: Pai-Mei Tseng, Somerset, NJ (US); Jyh-Yao Raphael Li, Parsippany, NJ (US)

(73) Assignee: INTEPLAST GROUP CORPORATION, Livingston, NJ (US)

( * ) Notice: Subject to any disclaimer, the term of this patent is extended or adjusted under 35 U.S.C. 154(b) by 114 days.

(21) Appl. No.: 18/175,731

(22) Filed: Feb. 28, 2023

(65) Prior Publication Data

US 2024/0286800 A1 Aug. 29, 2024

(51) Int. Cl.
*B65D 30/22* (2006.01)
*B65D 30/20* (2006.01)
*B65D 33/25* (2006.01)

(52) U.S. Cl.
CPC ..... *B65D 31/12* (2013.01); *B65D 31/10* (2013.01); *B65D 33/2566* (2013.01)

(58) Field of Classification Search
CPC ..... B65D 31/12; B65D 31/10; B65D 33/2566
USPC ..... 383/38, 39, 63, 120
See application file for complete search history.

(56) References Cited

U.S. PATENT DOCUMENTS

| | | | | |
|---|---|---|---|---|
| 1,469,080 | A * | 9/1923 | Goerk | A24F 15/12 206/256 |
| 3,503,759 | A | 3/1970 | Wilton | |
| 4,619,650 | A | 10/1986 | Wisdom | |
| 5,024,536 | A * | 6/1991 | Hill | B65D 31/12 383/38 |
| 6,234,675 | B1 | 5/2001 | Saad et al. | |
| 6,579,008 | B2 | 6/2003 | Price et al. | |
| 6,874,938 | B2 * | 4/2005 | Price | B65D 33/2508 383/122 |
| 7,556,429 | B2 | 7/2009 | Taheri | |
| 8,449,186 | B2 | 5/2013 | Bray | |
| 9,254,940 | B2 | 2/2016 | Bray | |
| D783,416 | S | 4/2017 | Bray | |
| 10,106,297 | B2 | 10/2018 | Chang et al. | |
| 10,189,607 | B2 | 1/2019 | Tseng et al. | |
| 10,689,182 | B1 * | 6/2020 | Thompson | B65D 81/3266 |
| 2003/0031388 | A1 | 2/2003 | Gipson et al. | |
| 2009/0034885 | A1 | 2/2009 | McGruder | |
| 2013/0202226 | A1 | 8/2013 | Hartzfield | |
| 2019/0152667 | A1 * | 5/2019 | Binder | B65D 21/0227 |
| 2019/0344931 | A1 * | 11/2019 | Kaila | B65D 77/30 |

FOREIGN PATENT DOCUMENTS

| | | | | |
|---|---|---|---|---|
| JP | 2000327042 | A * | 11/2000 | B65D 81/3266 |
| JP | 2011025944 | A * | 2/2011 | |
| WO | WO-2004002852 | A1 * | 1/2004 | B65D 75/008 |
| WO | WO-2010080067 | A1 * | 7/2010 | B65D 81/3261 |

OTHER PUBLICATIONS

Machine translation of JP-2011025944-A1 (Year: 2011).*
Machine translation of WO-2004002852-A1 (Year: 2004).*

* cited by examiner

*Primary Examiner* — Jes F Pascua
(74) *Attorney, Agent, or Firm* — Stinson LLP

(57) ABSTRACT

A multicompartment bag has at least three compartments that are resealable for opening and closing the compartments to receive items into and pass items out of the compartments. The bag is formed from a polymeric material. The openings are oriented to two opposite directions.

18 Claims, 1 Drawing Sheet

MULTICOMPARTMENT BAG

FIELD

The present disclosure generally relates to plastic bags and more particularly to plastic bags having multiple compartments.

BACKGROUND

Inexpensive plastic bags are ubiquitous in modern commerce for holding items for transport, protection and other reasons. Bags of this type can be formed in many ways, such as by forming a sheet of plastic into a tube, cutting the tube to length and then sealing one (bottom) end to form a bag. However, many other ways of forming bag are possible. Often one end of the bag has a reclosable opening, while an opposite end of the bag is permanently closed.

SUMMARY

In one aspect, a multicompartment bag of polymeric material generally comprises a first compartment including a first panel of the polymeric material and a second panel of the polymeric material in opposed relation to the first panel. The first and second panels include opposite side edge margins, top edge margins and bottom edge margins. The side edge margins and bottom edge margins are joined together to form a first compartment volume for receiving and holding items in the first compartment. A first closure located generally at the top edge margins of the first and second panels can be used to selectively connect and disconnect the first and second panels at the top edge margins thereby to form a first opening for passing items into and out of the first compartment. A second compartment includes a third panel of the polymeric material that is in opposed relation to the second panel of the first compartment. The third panel includes opposite side edge margins, a top edge margin and a bottom edge margin. The opposite side edge margins of the third panel are joined together with the opposite side edge margins of the second panel, and the top edge margin of the third panel are joined to the top edge margin of the second panel to form a second compartment volume for receiving and holding items in the second compartment. A second closure located generally at the bottom edge margins of the second and third panels can be used to selectively connect and disconnect the second and third panels at the bottom edge margins thereby to form a second opening for passing items into and out of the second compartment. A third compartment includes a fourth panel of the polymeric material that is in opposed relation to the third panel of the second compartment. The fourth panel includes opposite side edge margins, a top edge margin and a bottom edge margin. The opposite side edge margins of the fourth panel are joined together with the opposite side edge margins of the third panel and the bottom edge margin of the fourth panel are joined to the bottom edge margin of the third panel to form a third compartment volume for receiving and holding items in the third compartment. A third closure located generally at the top edge margins of the third and fourth panels can be used to selectively connect and disconnect the third and fourth panels at the top edge margins to form a third opening for passing items into and out of the third compartment.

Other objects and features of the present disclosure will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
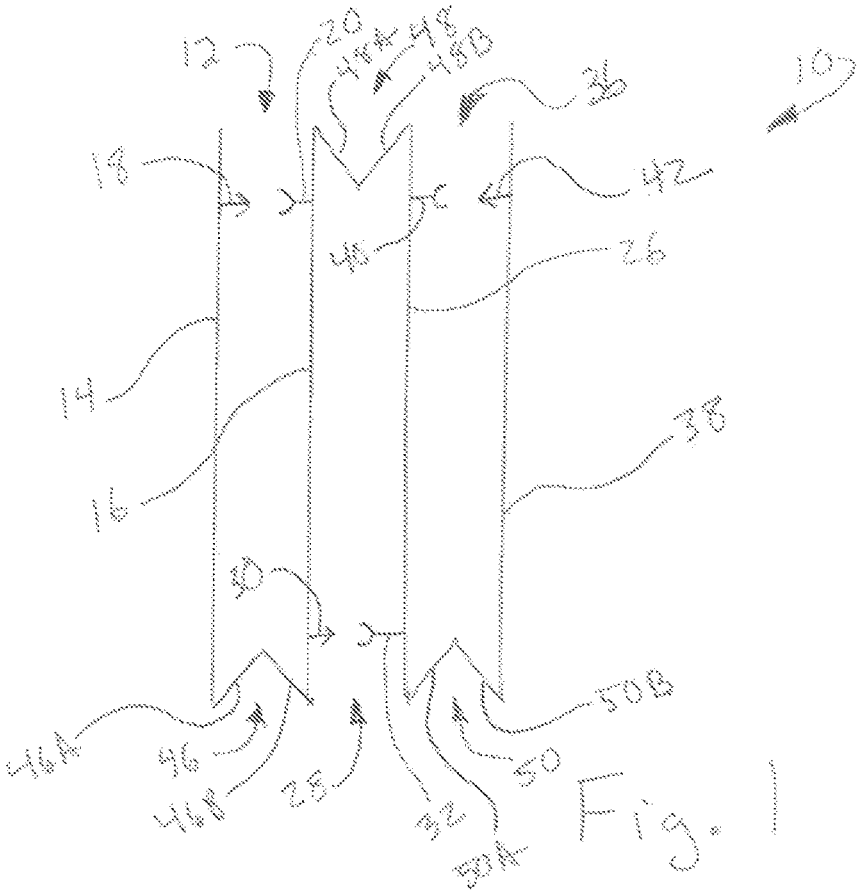
FIG. 1 is a schematic cross section of a multicompartment bag.

Referring now to the drawings, a bag constructed of polymeric material according to the principles of the present invention is designated generally at 10. The bag has multiple compartments, including a first compartment 12 comprising a first panel 14 and a second panel 16 in opposed relation to the first panel. The first and second panels 14, 16 have opposite side edge margins, top edge margins and bottom edge margins. The side edge margins and the bottom edge margins are operatively connected together. The opposing side edge margins and bottom edge margins of the first and second panels 14, 16 can be directly connected to each other or connected by intervening structure. For example, the bottom margins can be connected together by expandable gussets, as illustrated in the drawings. The gussets will be described more fully hereinafter. The connection or joining of the side edge margins and bottom edge margins define a first compartment volume between the first and second panels 14, 16 for receiving and holding items in the first compartment 12.

The first compartment further includes a first closure in the form of a zipper comprising a first (e.g., male) zipper element 18 and a second (e.g., female) zipper element 20. The first and second zipper elements 18, 20 are attached to the first and second panels 14, 16, respectively generally at the top margins of the first and second panels. The zipper can be selectively opened and closed by pressing the first and second zipper elements 18, 20 together and pulling them apart. When the first and second zipper elements 18, 20 are separated, the first and second panels 14, 16 define a first opening at the top of the first compartment 12. Items can be passed into and out of the first compartment 12 through the first opening. The first opening opens upwardly as the bag 10 is oriented in the drawings.

The bag 10 further includes a second compartment 28 having a third panel 26 that is in opposed relation with the second panel 16, but on an opposite side of the second panel from the first panel 14. The third panel 26 has opposite side margins, a top edge margin and a bottom edge margin. The opposite side edge margins of the third panel 26 are joined together with the side edge margins of the second panel 16. The top edge margin of the third panel 26 is operatively connected to the top edge margin of the second panel 16. The connection of the second and third panels 16, 26 in this manner forms a second compartment volume for receiving and holding items in the second compartment 28. The second compartment is defined by the second and third panels 16, 26.

A second closure in the form of a zipper comprising a first (e.g., male) zipper element 30 and a second (e.g., female) zipper element 32 is located generally at the bottom edge margins of the second and third panels 16, 26. The first and second zipper elements 30, 32 are attached to the second and third panels 16, 26, respectively generally at the bottom margins of the second and third panels. The zipper can be selectively opened and closed by pressing the first and second zipper elements 30, 32 together and pulling them apart. When the first and second zipper elements 30, 32 are separated, the second and third panels 16, 26 define a second opening at the bottom of the second compartment 28. Items can be passed into and out of the second compartment 28 through the second opening. The second opening opens downward as oriented in the drawings.

A third compartment 36 of the bag 10 includes a fourth panel 38. The fourth panel is in opposed relation to the third panel 26 of the second compartment 28, but on an opposite side of the third panel from the second panel 16. The fourth panel 38 includes opposite side edge margins, a top edge margin and a bottom edge margin. The opposite side edge margins of the fourth panel 38 are joined together with the corresponding opposite side edge margins of the third panel 26. The bottom edge margin of the fourth panel 38 is joined to the bottom edge margin of the third panel 26. The joinder of these edge margins of the third and fourth panels 26, 38 forms a third compartment volume for receiving and holding items in the third compartment 36. The third compartment is defined by the third and fourth panels 26, 38.

A third closure in the form of a zipper comprising a first (e.g., female) zipper element 40 and a second (e.g., male) zipper element 42 is located generally at the top edge margins of the third and fourth panels 26, 38. The first and second zipper elements 40, 42 are attached to the third and fourth panels 26, 38, respectively generally at the top margins of the third and fourth panels. The zipper can be selectively opened and closed by pressing the first and second zipper elements 40, 42 together and pulling them apart. When the first and second zipper elements 40, 42 are separated, the third and fourth panels 26, 38 define a third opening at the top of the third compartment 36. Items can be passed into and out of the third compartment 36 through the third opening. The third opening of the third compartment 36 opens upwardly in the orientation shown in the drawings.

It will be understood that although three compartments 12, 28, 36 are illustrated, any number of compartments could be formed by simply continuing the pattern of construction illustrated in FIG. 1. In the illustrated embodiment, a single sheet of polymeric material extends from the first panel 14 through the second and third panels 16, 26 to the fourth panel 38. Stated another way, the first through fourth panels 14, 16, 26, 38 are all formed as a single piece of polymeric material. It will be further understood that the first and second closures may be other than the zippers disclosed herein, including without limitation lines of adhesive.

Referring to FIG. 1, the bag 10 includes a first gusset 46 located between the first panel 14 and the second panel 16 at the bottom edge margins of the first and second panels. The first gusset 46 comprises a first fold 46A and a second fold 46B. The first and second folds can be folded together so that bottom exterior portions of the folds 46A, 46B are in face-to-face relation and the first compartment 12 is collapsed (e.g., the compartment volume goes to essentially zero). However, the first and second folds 46A, 46B can be expanded (e.g., unfolded) to increase the magnitude of the first compartment volume. A second gusset 48 joins the second panel 16 and the third panel 26 at top margins of the second and third panels. The second gusset 48 comprises a first fold 48A and a second fold 48B. The first and second folds 48A, 48B can be folded together so that top exterior surfaces of the folds are in face-to-face engagement and the second compartment 28 is collapsed (e.g., the compartment volume goes essentially to zero). However, the first and second folds 48A, 48B can be expanded (e.g., unfolded) to increase the magnitude of the volume of the second compartment 28. A third gusset 50 joins the third and fourth panels 26, 38 at the bottom margins of the third and fourth panels. The third gusset 50 comprises a first fold 50A and a second fold 50B. The first and second folds 50A, 50B can be folded together so that bottom exterior surfaces of the first and second folds are in face-to-face engagement and the third compartment 36 is collapsed (e.g., the volume of the third compartment goes essentially to zero). However, the first and second folds 50A, 50B can be expanded (e.g., unfolded) to increase the magnitude of the volume of the third compartment 36. It will be understood that the first, second and third gussets 46, 48, 50 can take on other constructions than illustrated herein. Moreover, it is possible that some of the compartments may include gussets and others may not. The gussets could be eliminated entirely. Moreover, in general when gussets are employed, there would be one gusset for each compartment, and as noted above the number of compartments can be more than three.

Figure 2:
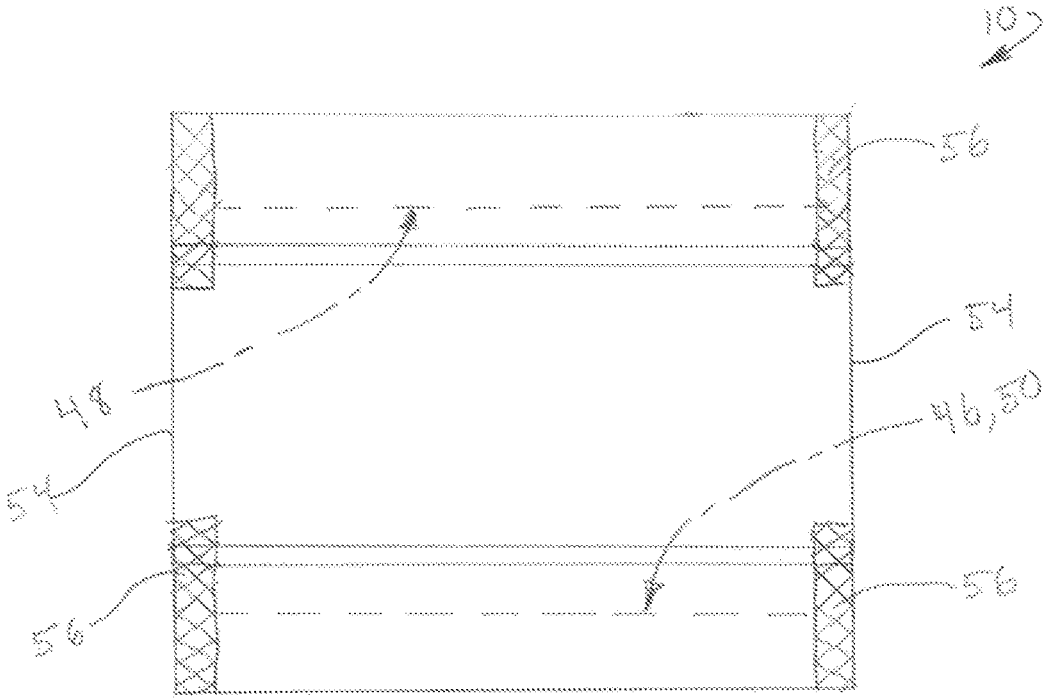
FIG. 2 is a front elevation view of the multicompartment bag.

As previously stated herein, the first side edge margins of the first and second panels 14, 16, second and third panels 16, 26, and third and fourth panels 26, 38 are joined together over their entire lengths. The joining can be made in any suitable manner, such as by ultrasonic or heat sealing. More particularly and in reference to FIG. 2, the joining between the adjacent panels includes narrow first seals 54 extending over the full lengths of the side margins and wider second seals 56 extending within the top and bottom regions of the side margins. The wider second seals 56 can be made in any suitable manner such as by ultrasonic weld or wide stamp seal. The second seals 56 are specifically located to overlap the zipper elements 18, 20, 30, 32, 40, 42. The second seals facilitate 56 a good connection between the first, second and third gussets 46, 48, 50 at these locations. It will be understood that the second seals 56 can be eliminated within the scope of the present invention.

As various changes could be made in the above products and methods without departing from the scope of the disclosure, it is intended that all matter contained in the above description shall be interpreted as illustrative and not in a limiting sense.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements. Moreover, directional terms such as "top", "bottom", "side" are used for convenience of description and to not require the article to have any particular orientation.

In view of the above, it will be seen that the several objects of the disclosure are achieved and other advantageous results attained.

What is claimed is:

1. A multicompartment bag of polymeric material comprising:

a first compartment including a first panel of the polymeric material and a second panel of the polymeric material in opposed relation to the first panel, the first and second panels including opposite side edge margins, top edge margins and bottom edge margins, the side edge margins and bottom edge margins being joined together to form a first compartment volume for receiving and holding items in the first compartment, and a first closure located generally at the top edge margins of the first and second panels for selectively connecting and disconnecting the first and second panels at the top edge margins thereby to form a first opening for passing items into and out of the first compartment;

a second compartment including a third panel of the polymeric material, the third panel being in opposed relation to the second panel of the first compartment, the third panel including opposite side edge margins, a top edge margin and a bottom edge margin, the opposite side edge margins of the third panel being joined together with the opposite side edge margins of the second panel, and the top edge margin of the third panel being joined to the top edge margin of the second panel to form a second compartment volume for receiving and holding items in the second compartment, and a second closure located generally at the bottom edge margins of the second and third panels for selectively connecting and disconnecting the second and third panels at the bottom edge margins thereby to form a second opening for passing items into and out of the second compartment;

a third compartment including a fourth panel of the polymeric material, the fourth panel being in opposed relation to the third panel of the second compartment, the fourth panel including opposite side edge margins, a top edge margin and a bottom edge margin, the opposite side edge margins of the fourth panel being joined together with the opposite side edge margins of the third panel and the bottom edge margin of the fourth panel being joined to the bottom edge margin of the third panel to form a third compartment volume for receiving and holding items in the third compartment, and a third closure located generally at the top edge margins of the third and fourth panels for selectively connecting and disconnecting the third and fourth panels at the top edge margins to form a third opening for passing items into and out of the third compartment;

a first gusset joining the first panel and the second panel at the bottom edge margins thereof;

a second gusset joining the second panel and the third panel at the top edge margins thereof; and a third gusset joining the third panel and the fourth panel at the bottom edge margins thereof.

2. The multicompartment bag as set forth in claim 1 wherein the polymeric material extending continuously from the first panel through the second and third panels and to the fourth panel.

3. The multicompartment bag as set forth in claim 1 wherein the first, second, third and fourth panels are formed as a single piece of the polymeric material.

4. The multicompartment bag as set forth in claim 1 further comprising a gusset of the polymeric material joining the first panel and the second panel at the bottom edge margins thereof.

5. The multicompartment bag as set forth in claim 1 further comprising a gusset of the polymeric material joining the second panel and the third panel at the top edge margins thereof.

6. The multicompartment bag as set forth in claim 1 further comprising a gusset of the polymeric material joining the third panel and the fourth panel at the bottom edge margins thereof.

7. The multicompartment bag as set forth in claim 1 wherein the first, second and third gussets are each expandable to increase the magnitude of the first, second and third compartment volumes.

8. The multicompartment bag as set forth in claim 1 wherein the first closure comprises a zipper including a first zipper element attached to the first panel and a second zipper element attached to the second panel, the first and second zipper elements being releasably mateable to close the first opening of the first compartment.

9. The multicompartment bag as set forth in claim 1 wherein the second closure comprises a zipper including a first zipper element attached to the second panel and a second zipper element attached to the third panel, the first and second zipper elements being releasably mateable to close the second opening of the second compartment.

10. The multicompartment bag as set forth in claim 1 wherein the third closure comprises a zipper including a first zipper element attached to the third panel and a second zipper element attached to the fourth panel, the first and second zipper elements being releasably mateable to close the third opening of the third compartment.

11. A multicompartment bag of polymeric material comprising:

a first compartment including a first panel of the polymeric material and a second panel of the polymeric material in opposed relation to the first panel, the first and second panels including opposite side edge margins, top edge margins and bottom edge margins, the side edge margins and bottom edge margins being joined together to form a first compartment volume for receiving and holding items in the first compartment, and a first closure located generally at the top edge margins of the first and second panels for selectively connecting and disconnecting the first and second panels at the top edge margins thereby to form a first opening for passing items into and out of the first compartment;

a second compartment including a third panel of the polymeric material, the third panel being in opposed relation to the second panel of the first compartment, the third panel including opposite side edge margins, a top edge margin and a bottom edge margin, the opposite side edge margins of the third panel being joined together with the opposite side edge margins of the second panel, and the top edge margin of the third panel being joined to the top edge margin of the second panel to form a second compartment volume for receiving and holding items in the second compartment, and a second closure located generally at the bottom edge margins of the second and third panels for selectively connecting and disconnecting the second and third panels at the bottom edge margins thereby to form a second opening for passing items into and out of the second compartment;

a third compartment including a fourth panel of the polymeric material, the fourth panel being in opposed relation to the third panel of the second compartment, the fourth panel including opposite side edge margins, a top edge margin and a bottom edge margin, the opposite side edge margins of the fourth panel being joined together with the opposite side edge margins of the third panel and the bottom edge margin of the fourth panel being joined to the bottom edge margin of the third panel to form a third compartment volume for receiving and holding items in the third compartment, and a third closure located generally at the top edge margins of the third and fourth panels for selectively connecting and disconnecting the third and fourth panels at the top edge margins to form a third opening for passing items into and out of the third compartment;

wherein the side edge margins of the first and second panels are joined together by a first seal having a first width and by a second seal having a second width greater than the first width, and wherein the second seal extends in the top margins of the first and second panels.

12. The multicompartment bag as set forth in claim 11 wherein the second seal includes portions extending in the bottom margins of the first and second panels, the second seal portions in the bottom margin being separate from the second seal in the top margin.

13. The multicompartment bag as set forth in claim 11 wherein the side edge margins of the second and third panels are joined together by a first seal having a first width and by a second seal having a second width greater than the first width.

14. The multicompartment bag as set forth in claim 13 wherein the second seal extends in the top margins of the second and third panels.

15. The multicompartment bag as set forth in claim 14 wherein the second seal includes portions extending in the bottom margins of the second and third panels, the second seal portions in the bottom margin being separate from the second seal in the top margin.

16. The multicompartment bag as set forth in claim 11 wherein the side edge margins of the third and fourth panels are joined together by a first seal having a first width and by a second seal having a second width greater than the first width.

17. The multicompartment bag as set forth in claim 16 wherein the second seal includes portions extending in the bottom margins of the third and fourth panels, the second seal portions in the bottom margin being separate from the second seal in the top margin.

18. The multicompartment bag as set forth in claim 17 wherein the second seal extends in the top margins of the third and fourth panels.

* * * * *